US006297596B1

(12) United States Patent
Kajihara

(10) Patent No.: US 6,297,596 B1
(45) Date of Patent: Oct. 2, 2001

(54) POWER SUPPLY CIRCUIT ARRANGED TO GENERATE INTERMEDIATE VOLTAGE AND LIQUID CRYSTAL DISPLAY DEVICE INCLUDING POWER SUPPLY CIRCUIT

(75) Inventor: Noriyuki Kajihara, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/542,885

(22) Filed: Apr. 4, 2000

(30) Foreign Application Priority Data

Jul. 28, 1999 (JP) ..... 11-213254

(51) Int. Cl.[7] ..... G05F 1/10

(52) U.S. Cl. ..... 315/160; 345/95; 323/282; 323/288

(58) Field of Search ..... 315/160, 169.1–169.4, 315/291, 307, 224; 345/30, 38, 94, 95, 210, 211, 87, 88; 323/271, 282, 288

(56) References Cited

U.S. PATENT DOCUMENTS 5,706,020 * 1/1998 Iwama ..... 345/87
5,801,671 * 9/1998 Kobayashi et al. ..... 345/95
5,959,439 * 9/1999 Shenai et al. ..... 323/282
6,046,577 * 4/2000 Rincon-Mora et al. ..... 323/282

FOREIGN PATENT DOCUMENTS 55-146487 11/1980 (JP) .

* cited by examiner

*Primary Examiner*—Don Wong
*Assistant Examiner*—Wilson Lee

(57) ABSTRACT

A power supply circuit includes a reference voltage generation circuit to generate reference voltages, an operational amplifier to receive a first reference voltage and an intermediate voltage, an operational amplifier to receive a second reference voltage and the intermediate voltage, an output buffer which includes a pair of transistors controlled to turn on/off according to outputs of the two operational amplifiers and generates the intermediate voltage, and a through current prevention circuit to prevent a through current supplied to the pair of transistors in the output buffer. The through current prevention circuit operates to turn off one of the pair of transistors when the other turns on. Thus, the through current in the pair of transistors can be prevented.

12 Claims, 16 Drawing Sheets

POWER SUPPLY CIRCUIT ARRANGED TO GENERATE INTERMEDIATE VOLTAGE AND LIQUID CRYSTAL DISPLAY DEVICE INCLUDING POWER SUPPLY CIRCUIT

BACKGROUND OF THE INVENTION

1. Field of the Invention

The present invention relates to power supply circuits and liquid crystal display devices. More particularly, the present invention relates to a power supply circuit arranged to generate an intermediate voltage and a liquid crystal display device operating according to an output of the power supply circuit.

2. Description of the Background Art

The arrangement of a conventional liquid crystal display device will be described with reference to FIG. 11. A liquid crystal display device 4000 shown in FIG. 11 includes a liquid crystal panel 4500 having pixels arranged in a matrix, a Y driver 4100 to drive the pixels of liquid crystal panel 4500 in the horizontal axis direction, an X driver 4200 to drive the pixels of liquid crystal panel 4500 in the vertical axis direction, a control circuit 4300 to control Y driver 4100 and X driver 4200, and a power supply circuit 4400 to supply Y driver 4100 and X driver 4200 with a reference power supply voltage for driving.

One example of the power supply circuit will be described with reference to FIG. 12. A power supply circuit 900 shown in FIG. 12 outputs reference power supply voltages through resistor division. Power supply circuit 900 includes resistors R1, R2, . . . , Rn which are connected in series between a node supplied with a power supplied voltage VEE and a node supplied with a ground voltage GND. Power supply circuit 900 is formed to divide a difference in voltage between power supply voltage VEE and ground voltage GND by bleeder resistors R1 to Rn and thereby obtain reference power supply voltages (intermediate voltages) V0 to V4, for example.

Another example of the conventional power supply circuit is as shown in FIG. 13. A power supply circuit 910 shown in FIG. 13 includes bleeder resistors R1 to Rn which are connected in series between a node supplied with power supply voltage VEE and a node supplied with ground voltage GND, and operational amplifiers OA0, OA1, . . . , OA4. Operational amplifiers OA0, OA1, . . . , OA4 are generically referred to as operational amplifiers OA.

Power supply circuit 910 divides a voltage which corresponds to a difference between power supply voltage VEE and ground voltage GND by using the resistors, performs impedance conversion through operational amplifiers OA to stabilize each intermediate voltage, and then outputs the intermediate voltages.

Operational amplifier OA includes transistors Q91, Q92, Q93, Q94 and Q95 as shown in FIG. 14. Transistors Q91, Q92 and Q95 are PMOS transistors while transistors Q93 and Q94 are NMOS transistors.

The gate of transistor Q91 is connected to an inversion input terminal N (corresponding to symbol "−" in FIG. 13), and the gate of transistor Q92 is connected to a non-inversion input terminal P (corresponding to symbol "+" in FIG. 13).

Transistors Q93 and Q94 have their sources receiving ground voltage GND. Transistor Q95 has its gate connected to a bias input terminal BIAS and supplied with a bias voltage. Transistor Q95 has its source receiving power supply voltage VEE and its drain connected commonly to the sources of transistors Q91 and Q92. Transistor Q95 serves as a constant current source to supply transistors Q91 and Q92 a suitable bias current.

Operational amplifier OA further includes transistors Q96 and Q97 and a capacitance element C0. Transistor Q97 is an NMOS transistor while transistor Q96 is a PMOS transistor. Transistor Q97 has its gate connected to the drain of transistor Q94, its source receiving the ground voltage, and its drain connected to an output terminal OUT.

Transistor Q96 is connected between a node supplied with power supply voltage VEE and output terminal OUT and has its gate supplied with the bias voltage from bias input terminal BIAS. Transistor Q96 operates as a constant current source load.

Capacitance element C0 is connected between the drain and the gate of transistor Q97.

In a liquid crystal display device, a larger number of pixels increases load capacitance, and higher impedance of a power supply for driving the liquid crystal causes a noise on a liquid crystal output waveform. When power supply circuit Q910 is used, degradation in the display quality can be prevented from dropping by attaining lower impedance through operational amplifiers OA.

In any of such conventional power supply circuits, the resistance value of a bleeder resistor is desirably smaller to stabilize a reference power supply voltage. However, a smaller resistance value of the bleeder resistor results in power consumption increase of the power supply circuit.

In power supply circuit Q910, if a sufficient power amount is to be obtained for liquid crystal display by using an operational amplifier, the current flowing in a constant current circuit in the operational amplifier has to be made higher to some extent. That substantially prevents lower power consumption.

In order to cope with the problem, Japanese Patent Laying-Open No. 55-146487 (hereinafter, referred to as Document 1) discloses a power supply circuit which can stabilize an output voltage even if the resistance value of a bleeder resistor is made higher.

The power supply circuit arrangement shown in Document 1 will be described with reference to FIG. 15. A power supply circuit 920 shown in FIG. 15 obtains intermediate voltages using higher resistance and detects voltage fluctuation which exceeds an acceptable value to suppress the fluctuation using MOS transistors.

Power supply circuit 920 includes resistors R1 to R8, operational amplifiers OA1 to PA4, transistors Q1 to Q4, and a power supply E. Power supply E is connected between a node Z0 and a node Z3. Resistors R1 to R3 are connected in series between nodes Z0 and Z3. Resistors R1 to R3 produce intermediate voltages (−V1), (−V2) which are provided by dividing the power supply voltage (−E=−V3) into three.

Resistors R4 to R8 are connected in series between nodes Z0 and Z3. Resistors R4 to R8 produce reference voltages (−VH1, −VL1, and (−VH2, −VL2), for setting acceptable fluctuation values, based on intermediate voltages (−V1), (−V2) as a center. The following expressions (1) to (4) are satisfied between the reference voltages and the intermediate voltages.

$$-VH1=-V1+\Delta V \quad (1)$$

$$-VL1=-V1-\Delta V \quad (2)$$

$$-VH2=-V2+\Delta V \quad (3)$$

$$-VL2=-V2-\Delta V \quad (4)$$

In expressions (1) to (4), ΔV represents an acceptable fluctuation value.

Power supply circuit 920 further includes an operational amplifier OA1 receiving reference voltage (−VH1) at its inversion input terminal ("−") and voltage (−V1) at its non-inversion input terminal ("+"), and a transistor Q2 connected between a node Z1 for outputting voltage (−V1) and node Z3 for outputting a voltage (−V3) and receiving an output of operational amplifier OA1 at its gate. Transistor Q2 is an NMOS transistor. If voltage (−V1) fluctuates and becomes higher than reference voltage (−VH1), transistor Q2 turns on. Thus, fluctuation in the output so that the output is higher than the acceptable value is suppressed.

Power supply circuit 920 further includes an operational amplifier OA2 receiving reference voltage (−VL1, at its inversion input terminal ("−") and voltage (−V1) at its non-inversion input terminal ("+"), and a transistor Q1 connected between node Z1 and node Z0 for outputting a voltage V0 and receiving an output of operational amplifier OA2 at its gate. Transistor Q1 is a PMOS transistor. If voltage (−V1) fluctuates and becomes lower than reference voltage (−VL1), transistor Q1 turns on. Thus, fluctuation in the output so that the output is lower than the acceptable value is suppressed.

Power supply circuit 920 further includes an operational amplifier OA3 receiving reference voltage (−VH2, at its inversion input terminal ("−") and voltage (−V2) at its non-inversion input terminal ("+"), and a transistor Q4 connected between a node Z2 for outputting voltage (−V2) and node Z3 and receiving an output of operational amplifier OA3 at its gate. Transistor Q4 is an NMOS transistor. If voltage (−V2) fluctuates and becomes higher than reference voltage (−VH2, transistor Q4 turns on. Thus, fluctuation in the output so that the output is higher than the acceptable value is suppressed.

Power supply circuit 920 further includes an operational amplifier OA4 receiving reference voltage (−VL2, at its inversion input terminal ("−") and voltage (−V2) at its non-inversion input terminal ("+"), and a transistor Q3 connected between nodes Z2 and Z0 and receiving an output of operational amplifier OA4 at its gate. Transistor Q3 is a PMOS transistor. If voltage (−V2) fluctuates and becomes lower than reference voltage (−VL2), transistor Q3 turns on. Thus, fluctuation in the output so that the output is lower than the acceptable value is suppressed.

In short, fluctuation in each generated voltage (−V1) or (−V2) is limited within the acceptable voltage range 2×ΔV.

Here, the output impedance of the reference voltage generation circuit (resistors R4 to R8) does not cause any problems even if it is high impedance. This is because operational amplifier outputs are low impedance. Therefore, serial resistors R4 to R8 can have high resistance and current consumption in serial resistors R4 to R8 can be suppressed to be extremely small. Furthermore, the operational amplifiers are dynamically driven only when the outputs fluctuate and become higher or smaller than the acceptable values. Because of the reason as described above, current consumption is extremely small.

However, conventional power supply circuit 920 has the following problems due to variation in the characteristics of circuit components. The conventional problems will be described with reference to FIGS. 15 and 16.

FIG. 16 shows part of a power supply circuit having a similar arrangement to that of power supply circuit 920 described above, and the circuit shown in FIG. 16 is adapted to generate a voltage V4, for example. The power supply circuit shown in FIG. 16 includes a reference voltage generation circuit 94, operational amplifiers OA1, OA2, and an output buffer 5.

Reference voltage generation circuit 94 includes a bleeder resistor R0 to generate reference voltages Va, Vb which define a window width voltage. Output buffer 5 includes transistors Q100, Q200. Transistor Q100 is a PMOS transistor while transistor Q200 is an NMOS transistor. The source of transistor Q100 receives power supply voltage VEE while the source of transistor Q200 receives ground voltage GND. The gate of transistor Q100 receives an output of operational amplifier OA2, and the gate of transistor Q200 receives an output of operational amplifier OA1. The drain of transistor Q100 and the drain of transistor Q200 are both connected to a node for outputting a voltage V4.

Respective non-inversion input terminals (symbol "+") of operational amplifiers OA1, OA2 receive voltage V4. Operational amplifier OA1 receives reference voltage Va at its inversion input terminal (symbol "−"), and operational amplifier OA2 receives reference voltage Vb at its inversion input terminal.

Operational amplifiers OA1, OA2 each have the arrangement shown in FIG. 14. Operational amplifier OA described above having the arrangement shown in FIG. 14 has an offset voltage which is produced by a difference AVth between the threshold voltage of the differential input transistor on the non-inversion input terminal side and a differential input transistor on the inversion input terminal side. For example, the offset voltage is caused by implantation variation when impurities are ion-implanted into a silicon substrate under a region for formation of a transistor gate during the manufacturing process.

In FIG. 16, variation of the offset voltages of operational amplifiers OA1, OA2 in the same direction does not cause any particular problems. However, a total sum of the offset voltages varies in such a direction that reduces window width voltage (Va−Vb) generated by the bleeder resistor in reference voltage generation circuit 94, it causes problems.

Table 1 indicates a case in which the window width voltage was originally set to 100 mV but it became as small as 60 mV because the offset voltages varied in different directions.

TABLE 1

| | Set Voltage Window | Output Voltage | Offset Voltage | Window Width |
|---|---|---|---|---|
| Operational Amplifier OA1 | Va = 1.1 V | 1.085 V | −15 mV | 60 mV |
| Operational Amplifier OA2 | Vb = 1.0 V | 1.025 V | +25 mV | |

As shown in Table 1, the window width voltage becomes smaller if the offset voltages vary in different directions. If the window width voltage becomes smaller, transistors Q100, Q200 included in output buffer 5 are easily rendered conductive at the same time and a through current is more likely to flow than usual. If the window width voltage becomes much smaller, transistors Q100, Q200 turn on at the same time.

If the through current is produced, the output voltage becomes unstable and actual output voltage V4 becomes lower than an expected value level. When such a power supply circuit is provided in a liquid crystal display device, therefore, problems that a liquid crystal display screen does not start, for example, are caused when power is on.

SUMMARY OF THE INVENTION

Therefore, an object of the present invention is to provide a power supply circuit capable of supplying a stable voltage at low power consumption.

According to one aspect of the present invention, a power supply circuit to generate an intermediate voltage between a power supply voltage applied to a power supply node and a ground voltage applied to a ground node includes a reference voltage generation circuit to generate a reference voltage which defines an acceptable fluctuation range of the intermediate voltage, a voltage comparison circuit to compare the intermediate voltage and the reference voltage and output the comparison result, a pair of switches connected between the power supply node and a voltage output node from which the intermediate voltage is output and between the ground node and the voltage output node and controlled to turn on/off according to an output of the voltage comparison circuit, and a through current prevention circuit to prevent a through current caused between the power supply node and the ground node through the pair of switches.

In the power supply circuit, preferably, the voltage comparison circuit includes a differential amplification circuit to receive the reference voltage and the intermediate voltage at its inputs and an output circuit to output a signal corresponding to the comparison result according to an output of the differential amplification circuit, the pair of switches includes first and second transistors receiving an output of the output circuit at their gates, and the through current prevention circuit turns off one of the first and second transistors, if the other turns on, according to the output of the differential amplification circuit.

Preferably, the power supply circuit further includes a control switch to electrically connect/disconnect a current path to the pair of switches according to a control signal.

In the power supply circuit, preferably, the differential amplification circuit includes a third transistor receiving the reference voltage at its gate, a fourth transistor receiving the intermediate voltage at its gate, a current source to supply a current to the third and fourth transistors, and a control switch to electrically connect/disconnect a current path between the third and fourth transistors and the current source according to a control signal.

In the power supply circuit, preferably, the output circuit includes an output node to output a signal corresponding to the comparison result, a third transistor connected between the output node and a prescribed voltage and receiving the output of the differential amplification circuit at its gate, a current source to supply a current to the output node, and a control switch to electrically connect/disconnect a current path between the current source and the third transistor according to a control signal.

According to the above described power supply circuit, generation of the through current due to fluctuation in the intermediate voltage can be prevented, which can reduce power consumption. Furthermore, the current path in the circuit can be electrically disconnected according to the control signal, which can reduce current consumption when operation is unnecessary.

Another object of the present invention is to provide a liquid crystal display device having a power supply circuit capable of stably supplying a voltage at low power consumption.

A liquid crystal display device according to another aspect of the present invention includes a liquid crystal panel including a plurality of pixels, a drive circuit to drive the liquid crystal panel, and a power supply circuit to generate an intermediate voltage between a power supply voltage applied to a power supply node and a ground voltage applied to a ground node and supply the intermediate voltage to the drive circuit, the power supply circuit including a reference voltage generation circuit to generate a reference voltage which defines an acceptable fluctuation range of the intermediate voltage, a voltage comparison circuit to compare the intermediate voltage and the reference voltage and output the comparison result, a pair of switches connected between the power supply node and a voltage output node from which the intermediate voltage is output and between the ground node and the voltage output node and controlled to turn on/off according to the output of the voltage comparison circuit, and a through current prevention circuit to prevent a through current caused between the power supply node and the ground node through the pair of switches.

In the liquid crystal display device, preferably, the voltage comparison circuit includes a differential amplification circuit to receive the reference voltage and the intermediate voltage at its inputs, and an output circuit to output a signal corresponding to the comparison result according to an output of the differential amplification circuit, the pair of switches includes first and second transistors receiving an output of the output circuit at their gates, and the through current prevention circuit turns off one of the first and second transistors, if the other turns on, according to the output of differential amplification circuit.

Preferably, the liquid crystal display device further includes a control switch to electrically connect/disconnect a current path to the pair of switches according to a control signal.

In the liquid crystal display device, preferably, the differential amplification circuit includes a third transistor receiving the reference voltage at its gate, a fourth transistor receiving the intermediate voltage at its gate, a current source to supply a current to the third and fourth transistors, and a control switch to electrically connect/disconnect a current path between the third and fourth transistors and the current source according to a control signal.

In the liquid crystal display device, preferably, the output circuit includes an output node to output a signal corresponding to the comparison result, a third transistor connected between the output node and a prescribed voltage and receiving the output of differential amplification circuit at its gate, a current source to supply a current to the output node, and a control switch to electrically connect/disconnect a current path between the current source and the third transistor according to a control signal.

According to the above described liquid crystal display device, a low power consumption and high quality screen can be provided by a power supply circuit capable of preventing the through current and reducing unnecessary current consumption.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
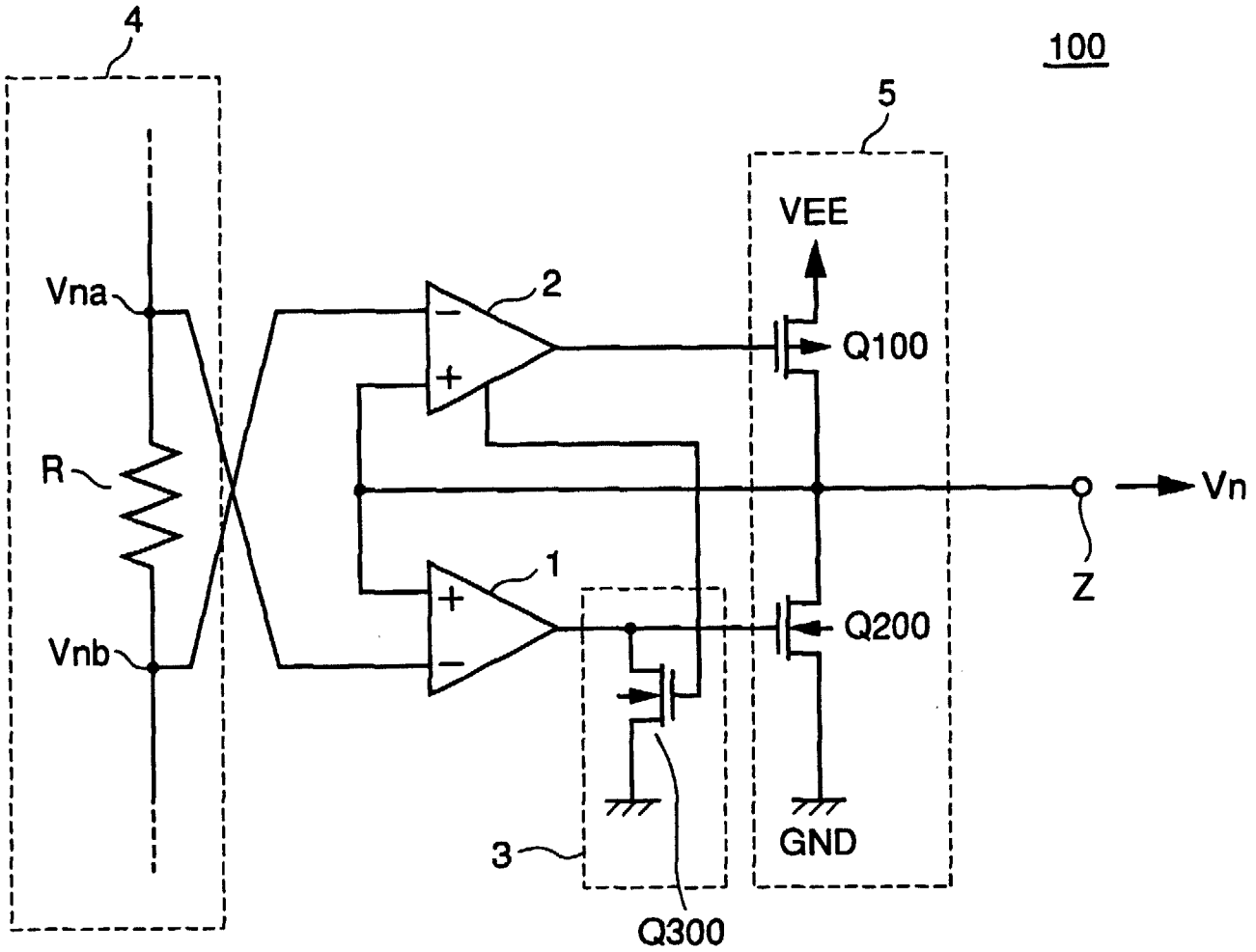
FIG. 1 is a circuit diagram showing an arrangement of a main part of a power supply circuit 100 according to a first embodiment.

In the following, the arrangements according to the present invention will be described in detail with reference to the drawings. In the drawings, the same or corresponding parts are denoted by the same reference characters and their description will not be repeated.

FIRST EMBODIMENT

Figure 2:
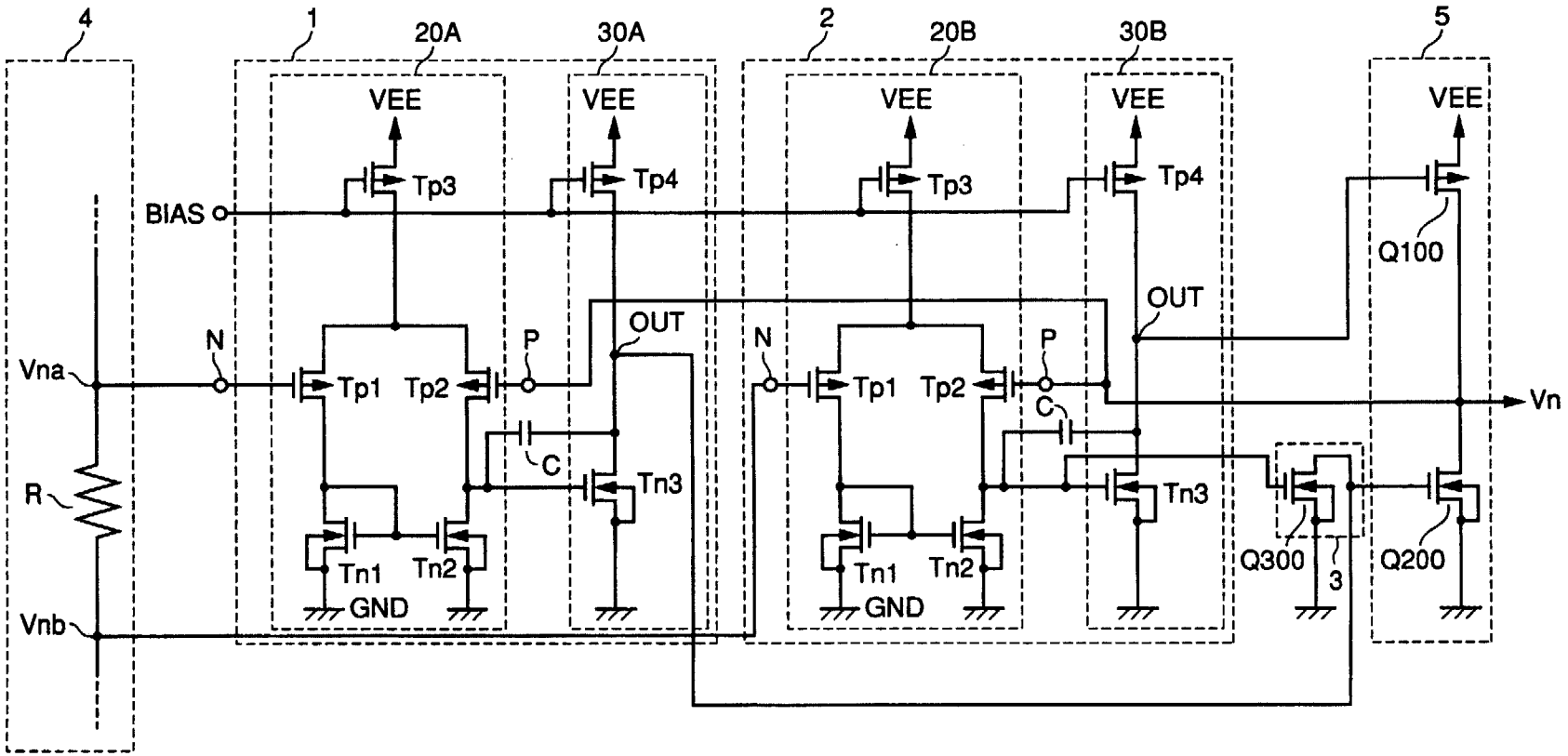
FIG. 2 is a circuit configuration diagram showing power supply circuit 100 at a transistor level.

An arrangement of a main part of a power supply circuit 100 according to a first embodiment will be described with reference to FIGS. 1 and 2. FIG. 1 is a circuit diagram showing the arrangement of the main part of power supply circuit 100, and FIG. 2 is a circuit configuration diagram showing the circuit of FIG. 1 at a transistor level. Power supply circuit 100 according to the first embodiment includes a reference voltage generation circuit 4, operational amplifiers 1, 2 provided for reference voltage generation circuit 4, a through current prevention circuit 3, and an output buffer 5.

Reference voltage generation circuit 4 includes a bleeder resistor to generate a window width voltage. The figure shows a bleeder resistor R to generate reference voltages Vna, Vnb which define a prescribed window width voltage.

Output buffer 5 includes transistors Q100, Q200. Transistor Q100 is a PMOS transistor while transistor Q200 is an NMOS transistor.

The source of transistor Q100 receives a power supply voltage VEE, and the source of transistor Q200 receives a ground voltage GND. The gate of transistor Q100 receives an output of operational amplifier 2, the gate of transistor Q200 receives an output of operational amplifier 1. The drain of transistor Q100 and the drain of transistor Q200 are both connected to a node Z for outputting intermediate voltages Vn.

Operational amplifiers 1, 2 have their non-inversion input terminals (symbol "+") connected to node Z and supplied with voltage Vn. Operational amplifier 1 receives reference voltage Vna at its inversion input terminal (symbol "–"), and operational amplifier 2 receives reference voltage Vnb at its inversion input terminal.

Through current prevention circuit 3 includes a transistor Q300. Transistor Q300 is an NMOS transistor. Transistor Q300 has its source supplied with ground potential GND and its drain connected to an output terminal of operational amplifier 1. Transistor Q300 is rendered conductive according to an output of a differential amplification circuit included in operational amplifier 2 described below.

As shown in FIG. 2, operational amplifier 1 includes a differential amplification circuit 20A, an output buffer 30A and a capacitance element C, and operational amplifier 2 includes a differential amplifier 20B, an output buffer 30B and a capacitance element C. Differential amplification circuits 20A, 20B have the same arrangement, and output buffers 30A, 30B have the same arrangement. In the following, differential amplification circuits 20A, 20B are generically called differential amplification circuits 20, and output buffers 30A, 30B are generically called output buffers 30.

In FIG. 2, N denotes an inversion input terminal (symbol "–" in FIG. 1), P denotes a non-inversion input terminal (symbol "+" in FIG. 1), BIAS denotes a bias input terminal supplied with a prescribed bias voltage, and OUT denotes an output terminal.

Differential amplification circuit 20 includes transistors Tp1, Tp2, Tp3, Tn1 and Tn2. Transistors Tp1, Tp2, and Tp3 are PMOS transistors while transistors Tn1 and Tn2 are NMOS transistors. Transistors Tp1, Tp2 form a differential pair.

Transistor Tp1 has its gate connected to inversion input terminal N and supplied with reference voltage Vna or Vnb. Transistor Tp2 has its gate connected to non-inversion input terminal P and supplied with voltage Vn at node Z.

Transistors Tn1, Tn2 are active loads of transistors Tp1, Tp2 and have their sources supplied with ground voltage GND.

Transistor Tp3 has its gate connected to bias input terminal BIAS and supplied with a bias voltage at a predetermined voltage level. Transistor Tp3 has its source supplied with power supply voltage VEE and its drain connected commonly to the sources of transistors Tp1, Tp2. Transistor Tp3 serves as a constant current source to supply a suitable bias current to transistors Tp1, Tp2.

Output buffer 30 includes transistors Tn3, Tp4. Transistor Tn3 is an NMOS transistor while transistor Tp4 is a PMOS transistor. Transistor Tn3 has its gate connected to the drain of transistor Tp2 included in differential amplification circuit 20, its source supplied with the ground voltage, and its drain connected to output terminal OUT.

Transistor Tn3 is rendered conductive according to a drain voltage of transistor Tp2 and thereby supplies a current. The current is supplied through output terminal OUT to the gate of transistor Q200 or transistor Q100 which forms output buffer 5.

Transistor Tp4 is connected between a node supplied with power supply voltage VEE and output terminal OUT and has its gate supplied with the bias voltage from bias input terminal BIAS. Transistor Tp4 operates as a constant current source load. Here, capacitor C connected between the gate and the drain of transistor Tn3 is provided for phase compensation.

The amount of current flowing in transistor Tp2 is controlled according to a voltage level of voltage Vn which is input to non-inversion input terminal P. In addition, the amount of current flowing in output transistor Tn3 is changed by controlling the amount of current supplied from transistor Tp1 through a current mirror circuit (formed of transistors Tn1, Tn2) according to a voltage level of voltage Vna which is received at inversion input terminal N.

If voltage Vn received at non-inversion input terminal P is higher than voltage Vna received at inversion input terminal N (Vn>Vna) as an example, the current flow in output transistor Tn3 decreases. If voltage Vn received at non-inversion input terminal P is lower than voltage Vna received at inversion input terminal N (Vn<Vna), the current flow in output transistor Tn3 increases.

The current flowing in output transistor Tn3 is compared against a load current which is supplied to transistor Tp4 by the bias voltage from bias input terminal BIAS. According to the comparison result, the voltage which is output from output terminal OUT changes.

If voltage Vn does not change, transistors Q100, Q200 in output buffer 5 do not turn on and thus the current is not provided.

If voltage Vn fluctuates and becomes higher than reference voltage Vna, transistor Q200 in output buffer 5 turns on. Thus, fluctuation in the output so that the output is higher than an acceptable value is suppressed.

If voltage Vn fluctuates and becomes lower than reference voltage Vnb, transistor Q100 in output buffer 5 turns on. Thus, fluctuation in the output so that the output is lower than an acceptable value is suppressed.

If a total sum of the offset voltages of operational amplifiers 1, 2 varies in such a direction that reduces the window width voltage (Vna–Vnb) generated by bleeder resistor R in reference voltage generation circuit 4, through current prevention circuit 3 prevents a through current which flows in transistors Q100, Q200.

The arrangement and operation of through current prevention circuit 3 will be described in detail. Transistor Q300 included in through current prevention circuit 3 has its source supplied with ground voltage GND, its gate connected to the drain of transistor Tp2 included in operational amplifier 2, and its drain supplied with a voltage at output terminal OUT in operation amplifier 1. The gate of transistor Q300 is supplied with a voltage of the same potential as the gate of transistor The included in output buffer 30B (the drain voltage of transistor Tp2 included in differential amplification circuit 20B).

If transistor Q100 having its gate connected to output terminal OUT of operational amplifier 2 is on (that is, transistor Tn3 of operational amplifier 2 is on and transistors Tp4, Tn3 are supplied with the current), transistor Q300 which is formed in the same LSI chip and thus has similar characteristics turns on similarly to transistor Tn3.

When transistor Q300 turns on, the potential at the gate of transistor Q200 and the potential at output terminal OUT of operation amplifier 1 assume a ground voltage level. Thus, transistor Q200 is forced to turn off. In other words, through current prevention circuit 3 operates so that transistors Q100, Q200 which form output buffer 5 are not on at the same time. Although transistor Q100 is on when transistor Q200 is off in the above description, the state of the transistors is not limited to the above case.

As described above, according to the arrangement of the first embodiment, even if a total sum of the offset voltages of operational amplifiers 1, 2 varies in such a direction that reduces the window width voltage (Vna–Vnb) generated by bleeder resistor R included in reference voltage generation circuit 4, through current prevention circuit 3 can prevent occurrence of a through current due to transistors Q100, Q200 included in output buffer 5. Therefore, a power supply circuit capable of outputting a stable voltage at low current consumption is implemented.

Figure 3:
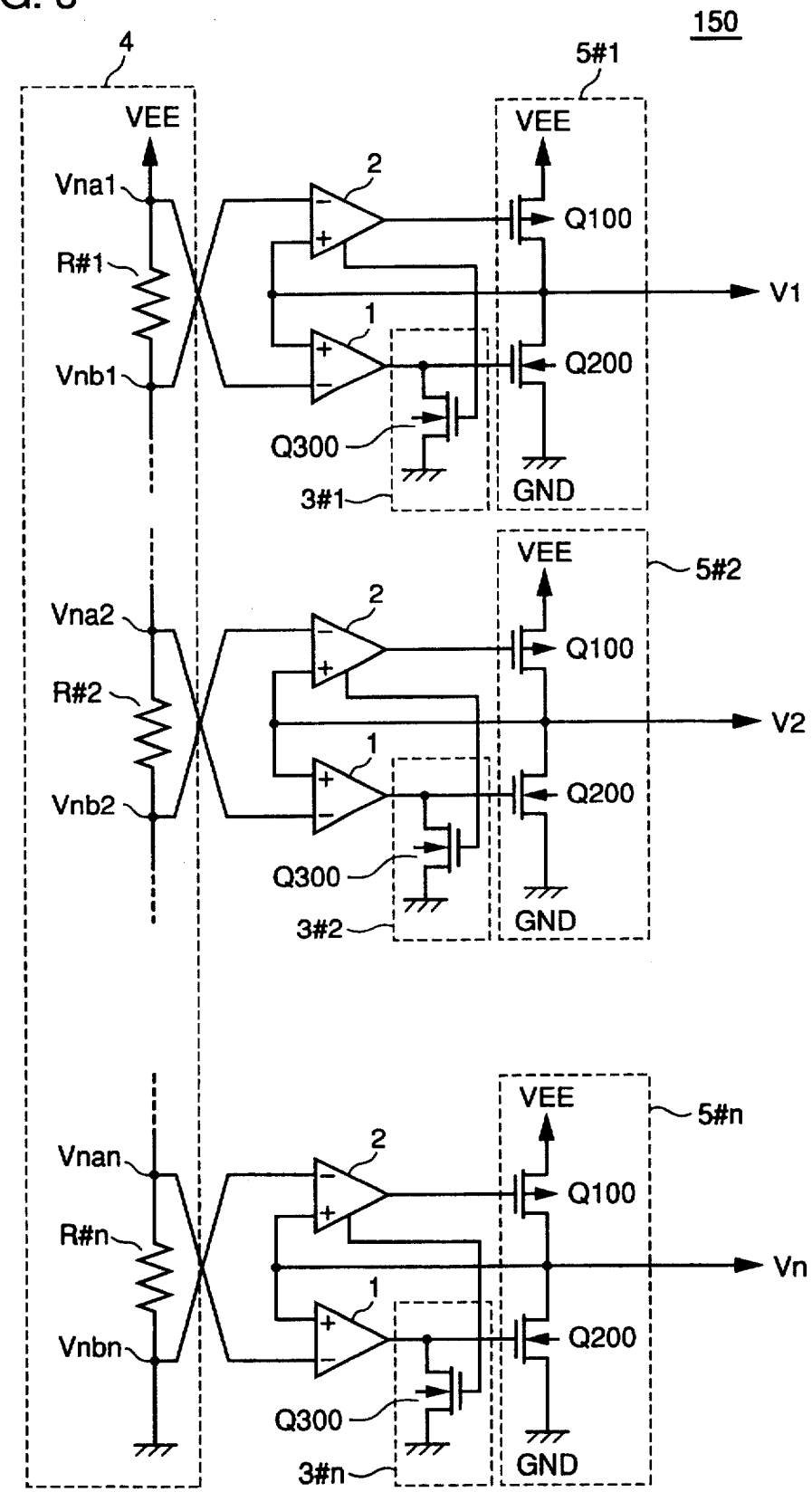
FIG. 3 shows an arrangement of a main part of a power supply circuit 150 which includes power supply circuit 100 as a basic component.

An arrangement of a power supply circuit 150 which includes a plurality of such power supply circuits and generates a plurality of intermediate voltages is shown in FIG. 3. The power supply circuits shown in FIG. 3 includes a reference voltage generation circuit 4 which includes a plurality of bleeder resistors R#1, R#2, . . . , R#n, a plurality of operational amplifiers 1, 2 which are provided to correspond to the bleeder resistors, output buffers 5#1, 5#2, . . . , 5#n, and through current prevention circuits 3#1, 3#2, . . . , 3#n which are provided to correspond to the output buffers.

Output buffers 5#1, 5#1, . . . , 5#n each include transistors Q100, Q200. Intermediate voltages V1, V2, . . . , Vn are output from the connection nodes of transistors Q100, Q200 in the output buffers.

Through current prevention circuits 3#1 to 3#n each include a transistor Q300 and prevent occurrence of a through current in a corresponding output buffer.

A liquid crystal display device which obtains a drive voltage from power supply circuit 100 will be described with reference to FIG. 4. A liquid crystal display device 1000 shown in FIG. 4 includes a liquid crystal panel 1500 having pixels arranged in a matrix, a Y driver 1100 to drive the pixels included in liquid crystal panel 1500 in the horizontal axis direction, an X driver 1200 to drive the pixels included in liquid crystal panel 1500 in the vertical axis direction, a control circuit 1300 to control Y driver 1100 and X driver 1200, and a power supply circuit 1400. Power supply circuit 1400 includes power supply circuit 100 and supplies Y driver 1100 and X driver 1200 with an operating power supply voltage for driving.

By provision of power supply circuit 1400 which allows low current consumption and output voltage stabilization, a liquid crystal display device providing a high display quality at low current consumption is implemented.

SECOND EMBODIMENT

Figure 5:
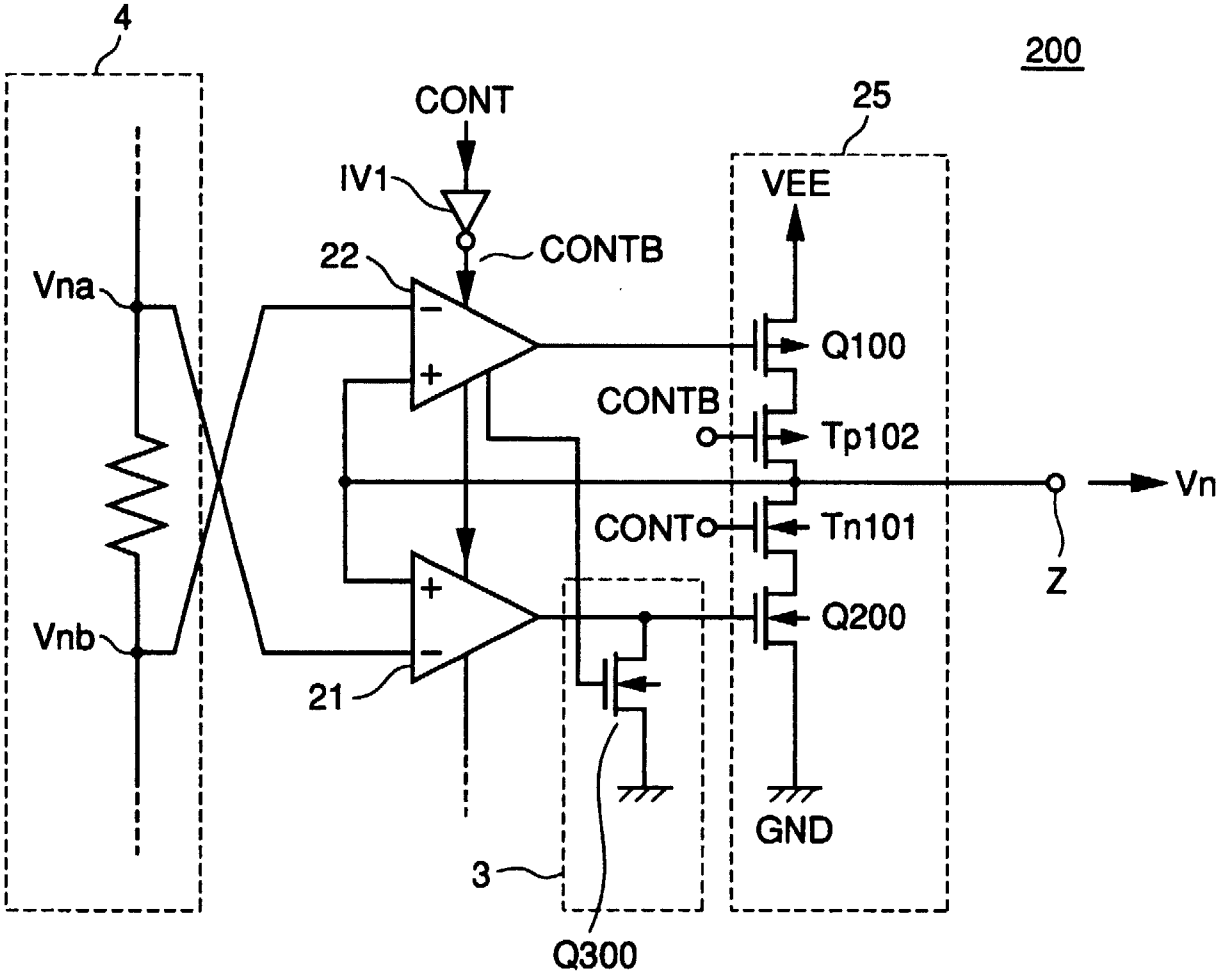
FIG. 5 is a circuit diagram showing an arrangement of a main part of a power supply circuit 200 according to a second embodiment.
Figure 6:
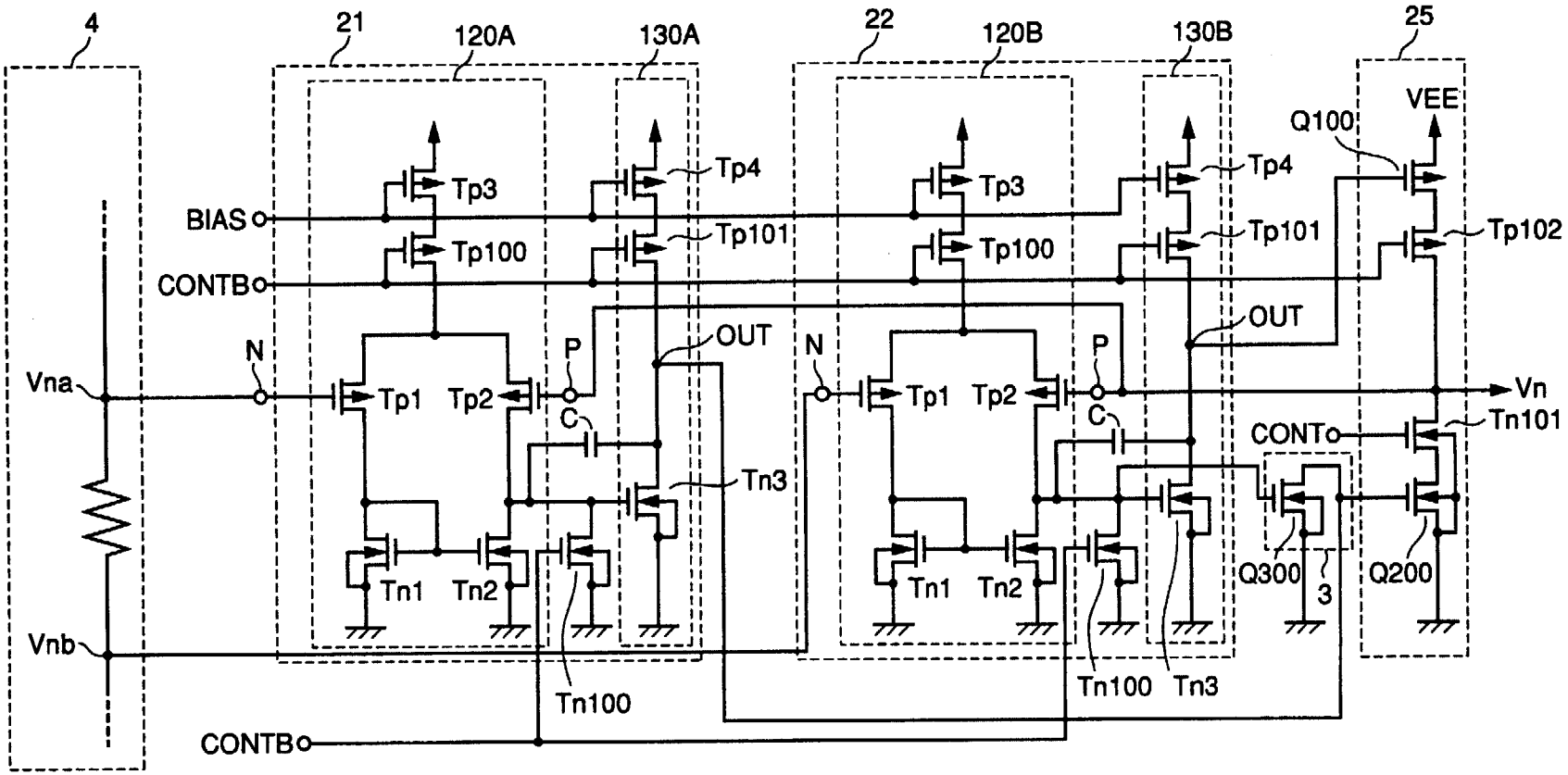
FIG. 6 is a circuit configuration diagram showing power supply circuit 200 at a transistor level.

An arrangement of a main part of a power supply circuit 200 according to a second embodiment will be described with reference to FIGS. 5 and 6. FIG. 5 is a circuit diagram showing the arrangement of the main part of power supply circuit 200, and FIG. 6 is a circuit configuration diagram showing the circuit of FIG. 5 at a transistor level. Power supply circuit 200 according to the second embodiment includes reference voltage generation circuit 4, operational amplifiers 21, 22 provided for reference voltage generation circuit 4, an inverter IV1, through current prevention circuit 3, and an output buffer 25.

Inverter IV1 inverts a control signal CONT and outputs a control signal CONTB.

Output buffer 25 includes transistors Tp102, Tn101 in addition to the arrangement of output buffer 5. Transistor Tp102 is a PMOS transistor while transistor Tn101 is an NMOS transistor.

Transistor Tp102 is connected between the drain of transistor Q100 and node Z for outputting intermediate voltage Vn and has its gate supplied with control signal CONTB. Transistor Tn101 is connected between node Z and the drain of transistor Q200 and has its gate supplied with control signal CONT.

Operational amplifiers 21, 22 has their non-inversion input terminals (symbol "+") connected to node Z and supplied with voltage Vn. Operational amplifier 21 receives reference voltage Vna at its inversion input terminal (symbol "–"), and operational amplifier 22 receives reference voltage Vnb at its inversion input terminal. Operational amplifiers 21, 22 are supplied with control signal CONTB.

As shown in FIG. 6, operational amplifier 21 includes a differential amplification circuit 120A, an output buffer 130A, capacitance element C, and a transistor Tn100. Operational amplifier 22 includes a differential amplification circuit 120B, an output buffer 130B, capacitance element C, and transistor Tn100. Differential amplification circuits 120A, 120B have the same arrangement, and output buffers 130A, 130B have the same arrangement. In the following, differential amplification circuits 120A, 120B are generically called differential amplification circuits 120, and output buffers 130A, 130B are generically called output buffers 130.

In FIG. 6, N denotes an inversion input terminal (symbol "–" in FIG. 5), P denotes a non-inversion input terminal (symbol "+" in FIG. 5), BIAS denotes a bias input terminal supplied with a prescribed bias voltage, and OUT denotes an output terminal.

Differential amplification circuit 120 includes a transistor Tp100 in addition to the arrangement of differential amplification circuit 20. Transistor Tp100 is a PMOS transistor. Transistors Tp1, Tp2, Tn1 and Tn2 which form differential amplification circuit 20 are connected as described in the first embodiment. Transistor Tp100 is arranged between the drain of transistor Tp3 and the sources of transistors Tp1, Tp2. The gate of transistor Tp100 is supplied with control signal CONTB.

Output buffer 130 which is a source follower circuit includes a transistor Tp101 in addition to the arrangement of output buffers 30. Transistor Tp101 is a PMOS transistor.

Transistor Tp101 is arranged between the drain of transistor Tp4 and output terminal OUT. The gate of transistor Tp101 is supplied with control signal CONTB.

As described above, the second embodiment includes, in addition to the circuit configuration of the first embodiment, switch means (transistors Tp100, Tp101, Tp102) which are inserted on the drain sides of transistors Tp3, Tp4, Q100, respectively, to separate the constant current sources. The gates of the transistors which form the switch means are supplied with control signal CONTB. When control signal CONTB is at the H level (control signal CONT is at the L level), transistors Tp100, Tp101, Tp102 are off. Thus, the current flow to the circuit can be interrupted at desirable timing.

Although the current can be interrupted sufficiently by transistors Tp100, Tp101, Tp102 when the operation is unnecessary, the current paths in the circuit can be electrically disconnected perfectly by arranging transistor Tn100 on the gate side of transistor Tn3 or arranging transistor Tn101 on the drain side of transistor Q200.

In this case, transistor Tn100 is connected between the gate of transistor Tn3 and a node supplied with the ground voltage and supplied with control signal CONTB at its gate. Furthermore, transistor Tn101 is supplied with control signal CONT at its gate as described above.

In short, when control signal CONTB is at the H level (control signal CONT is at the L level), transistor Tn101 is off and thus the current path of output buffer 25 is electrically disconnected. Meanwhile, transistor Tn100 turns on and the gate of transistor Tn3 assumes the ground voltage level, and thus transistor Tn3 turns off. Thus, the current path of output buffer 130 is electrically disconnected.

As described above, by providing the switch means turned on/off by control signal CONT (and control signal CONTB which is an inversion signal), electric connection/disconnection of the current path in each circuit component of output buffer 130 and output buffer 25 can be controlled. By externally controlling H/L of the control signals, useless current consumption at desirable timing, for example when the operation is unnecessary can be prevented.

When a plurality of intermediate voltages are to be generated, a plurality of power supply circuits 200 are included, and control signals CONT, CONTB are supplied commonly to each power supply circuit.

Figure 4:
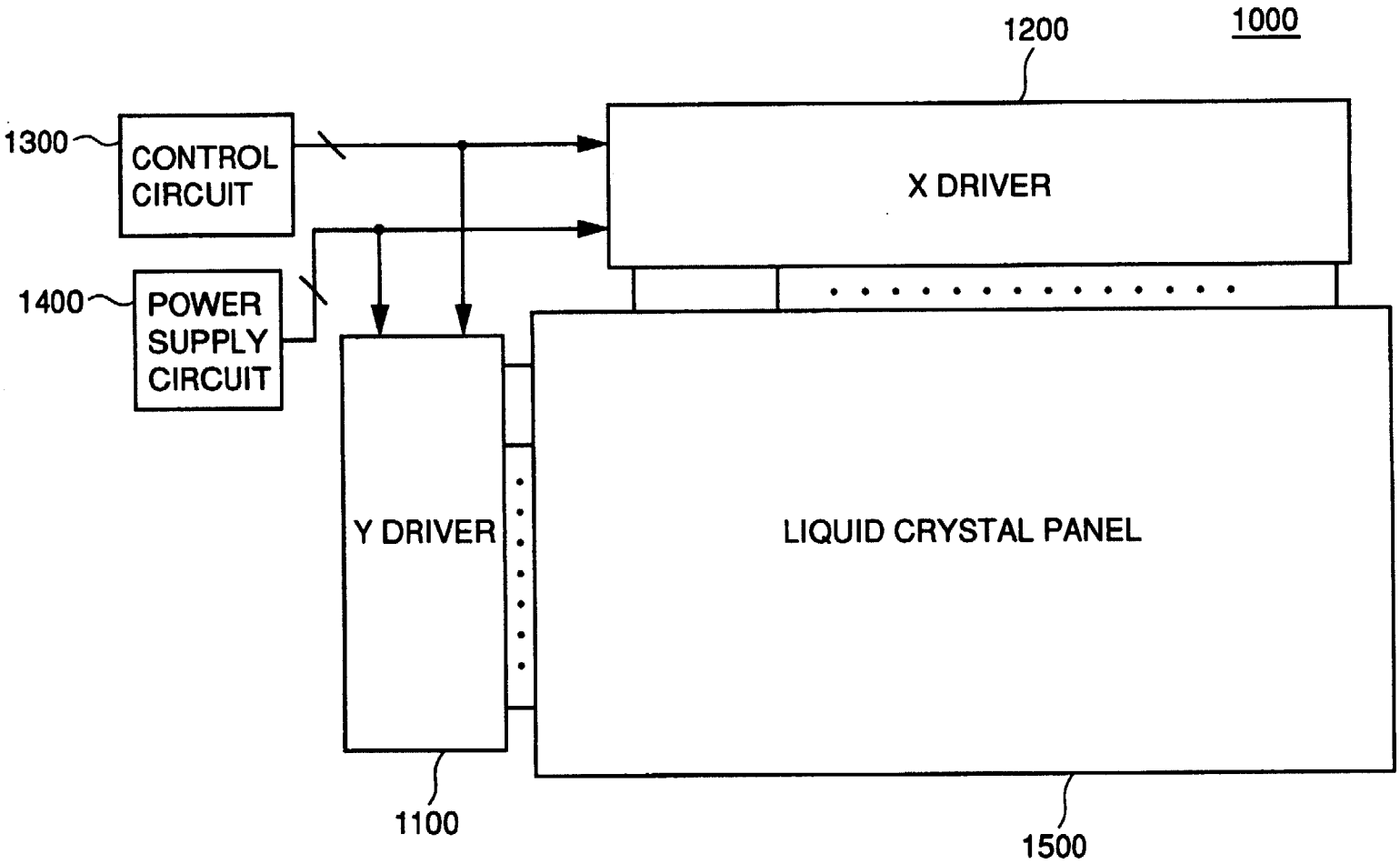
FIG. 4 is a block diagram showing a schematic arrangement of a liquid crystal display device 1000 according to the first embodiment.

It is noted that power supply circuit 1400 in the liquid crystal display device shown in FIG. 4 may be formed of power supply circuit 200. Power consumption can be reduced further in this case.

THIRD EMBODIMENT

Figure 7:
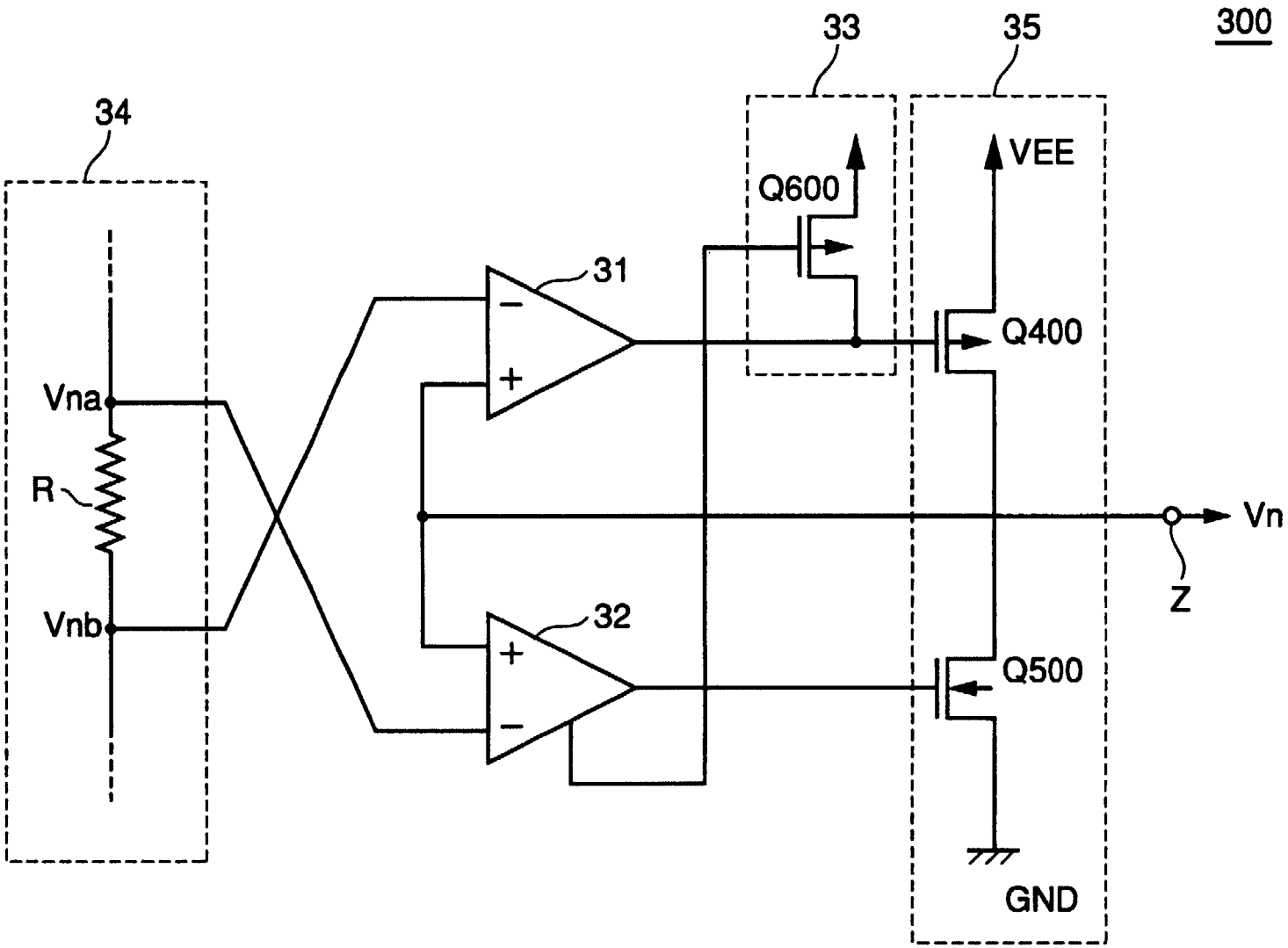
FIG. 7 shows an arrangement of a main part of a power supply circuit 300 according to a third embodiment.
Figure 8:
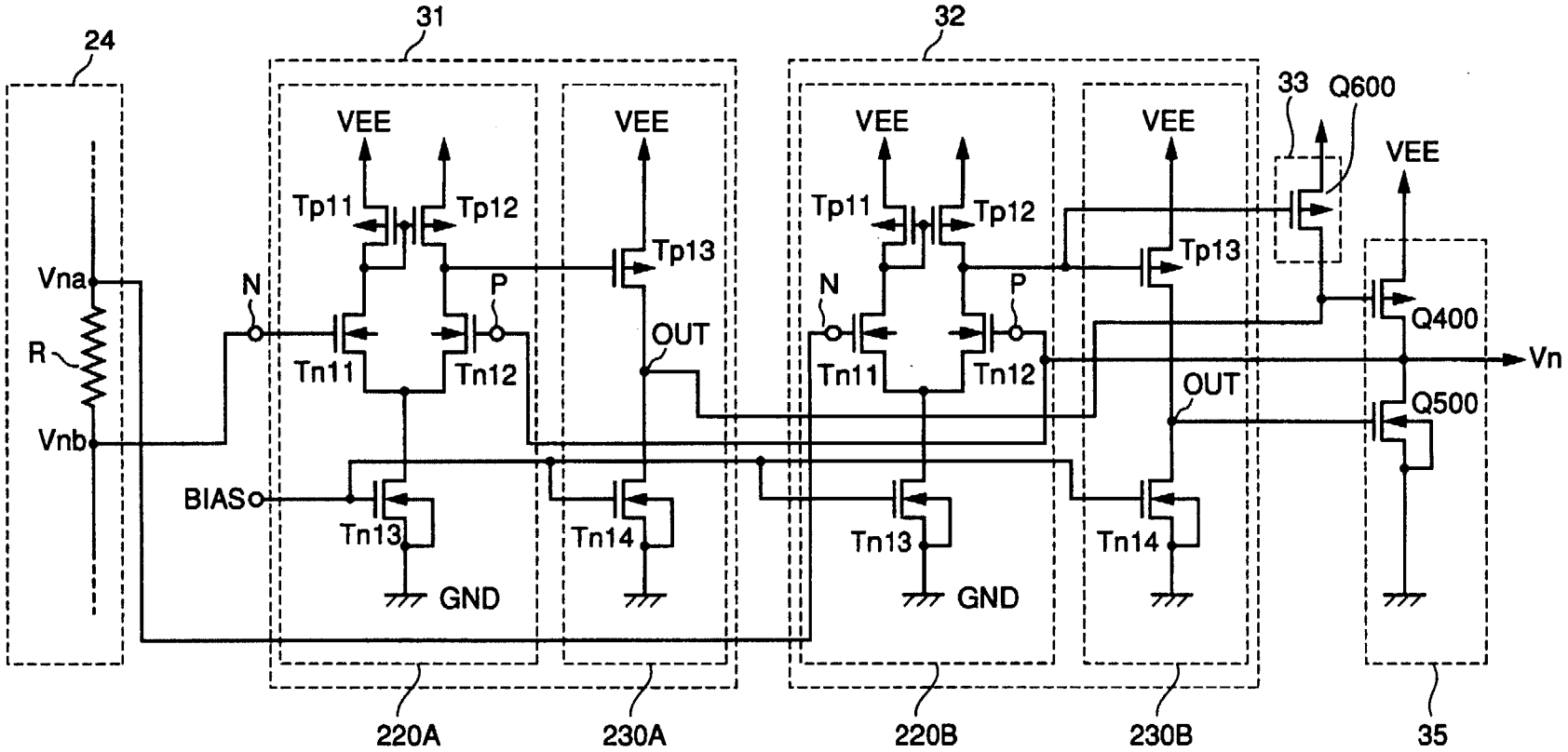
FIG. 8 is a circuit configuration diagram showing power supply circuit 300 at a transistor level.

An arrangement of a main part of a power supply circuit 300 according to a third embodiment will be described with reference to FIGS. 7 and 8. FIG. 7 is a circuit diagram showing the arrangement of the main part of power supply circuit 300, and FIG. 8 is a circuit configuration diagram showing the circuit of FIG. 7 at a transistor level. Power supply circuit 300 according to the third embodiment includes a reference voltage generation circuit 34, operational amplifiers 31, 32 arranged for reference voltage generation circuit 34, a through current prevention circuit 33, and an output buffer 35.

Reference voltage generation circuit 34 includes a bleeder resistor to generate a window width voltage. The figure shows a bleeder resistor R to generate reference voltages Vna, Vnb which define a prescribed window width voltage.

Output buffer 35 includes transistors Q400, Q500. Transistor Q400 is a PMOS transistor while transistor Q500 is an NMOS transistor.

The source of transistor Q400 is supplied with power supply voltage VEE, and the source of transistor Q500 is supplied with ground voltage GND. The gate of transistor Q400 is supplied with an output of operational amplifier 31, and the gate of transistor Q500 is supplied with an output of operational amplifier 32. The drain of transistor Q400 and the drain of transistor Q500 are both connected to node Z for outputting intermediate voltage Vn.

Operational amplifiers 31, 32 have their non-inversion input terminals (symbol "+") connected to node Z and supplied with voltage Vn. Operational amplifier 31 receives reference voltage Vnb at its inversion input terminal (symbol "–"), and operational amplifier 32 receives reference voltage Vna at its inversion input terminal.

Through current prevention circuit 33 includes a transistor Q600. Transistor Q600 is a PMOS transistor. Transistor Q600 has its source supplied with power supply voltage VEE, its drain connected to an output terminal of operational amplifier 31, and its gate supplied with an output of a differential amplification circuit included in operational amplifier 32.

As shown in FIG. 8, operational amplifier 31 includes a differential amplification circuit 220A and an output buffer 230A, and operational amplifier 32 includes a differential amplification circuit 220B and an output buffer 230B. Differential amplification circuit 220A, 220B have the same arrangement, and output buffers 230A, 230B have the same arrangement. In the following, differential amplification circuits 220A, 220B are generically called differential amplification circuits 220, and output buffers 230A, 230B are generically called output buffers 230.

In FIG. 8, N denotes an inversion input terminal (symbol "–" in FIG. 7), P denotes a non-inversion input terminal (symbol "+" in FIG. 7), BIAS denotes a bias input terminal supplied with a prescribed bias voltage, and OUT denotes an output terminal.

Differential amplification circuit 220 includes transistors Tp11, Tp12, Tn11, Tn12 and Tn13. Transistors Tp11, Tp12 are PMOS transistors while transistors Tn11, Tn12 and Tn13 are NMOS transistors.

The gates of transistor Tn11 is connected to inversion input terminal N and supplied with reference voltage Vna or Vnb. The gate of transistor Tn12 is connected to non-inversion input terminal P and supplied with voltage Vn at node Z.

Transistors Tp11, Tp12 have their sources supplied with power supply voltage VEE.

Transistor Tn13 has its gate connected to bias input terminal BIAS and supplied with the bias voltage at a predetermined voltage level. Transistor Tn13 has its source supplied with ground voltage GND and its drain connected commonly to the sources of transistors Tn11, Tn12. Transistor Tn13 operates as a constant current source to supply a suitable bias current to transistors Tn11, Tn12.

Output buffer 230 includes transistors Tp13, Tn14. Transistor Tn14 is an NMOS transistor while transistor Tp13 is a PMOS transistor. Transistor Tp13 has its source supplied with power supply voltage VEE, its drain connected to output terminal OUT, and its gate connected to the drain of transistor Tn12 included in differential amplification circuit 220.

Transistor Tp13 is rendered conductive according to a drain voltage of transistor Tn12 and thereby supplies a current. The current is supplied through output terminal OUT to the gate of transistor Q400 or Q500 which forms output buffer 35.

Transistor Tn14 is connected between output terminal OUT and a node supplied with ground voltage GND and has its gates supplied with the bias voltage from bias input terminal BIAS.

The gates of transistor Q600 which forms through current prevention circuit 33 is supplied with a voltage of the same potential as the gate of transistor Tp13 included in output buffer 230B (drain voltage of transistor Tn12 included in differential amplification circuit 220B).

The arrangement of the third embodiment is different from that of the first embodiment in that the NMOS transistors in the first embodiment are replaced by PMOS transistors and the PMOS transistors in the first embodiment are replaced by NMOS transistors (Tni→Tp1i, Tpi→Tn1i: i=1, 2, . . . ). Since the basic operation is the same as the circuit shown in FIGS. 1 and 2 in the first embodiment, detailed description thereof will not be repeated.

When transistor Q500 having its gate connected to output terminal OUT of operational amplifier 32 is on (that is, transistor Tp13 of operational amplifier 32 is on and transistors Tp13, Tn14 are supplied with the current), transistor Q600 which is formed in the same LSI chip and has similar characteristics turns on similarly to transistor Tp13.

When transistor Q600 turns on, the potential at the gate of transistor Q400 and the potential at output terminal OUT of operational amplifier 31 assume a power supply voltage level. Thus, transistor Q400 is forced to turn off.

In other words, in the third embodiment, through current prevention circuit 33 operates so that transistors Q400, Q500 which form output buffer 35 are not on at the same time. Thus, occurrence of an unnecessary through current can be prevented.

When a plurality of intermediate voltages are to be generated, a plurality of such power supply circuits 300 are included.

Here, power supply circuit 1400 in the liquid crystal display device shown in FIG. 4 may be formed of power supply circuit 300. Similarly to the first embodiment, a liquid crystal display device allowing a high display quality at low power consumption is implemented.

Figure 15:
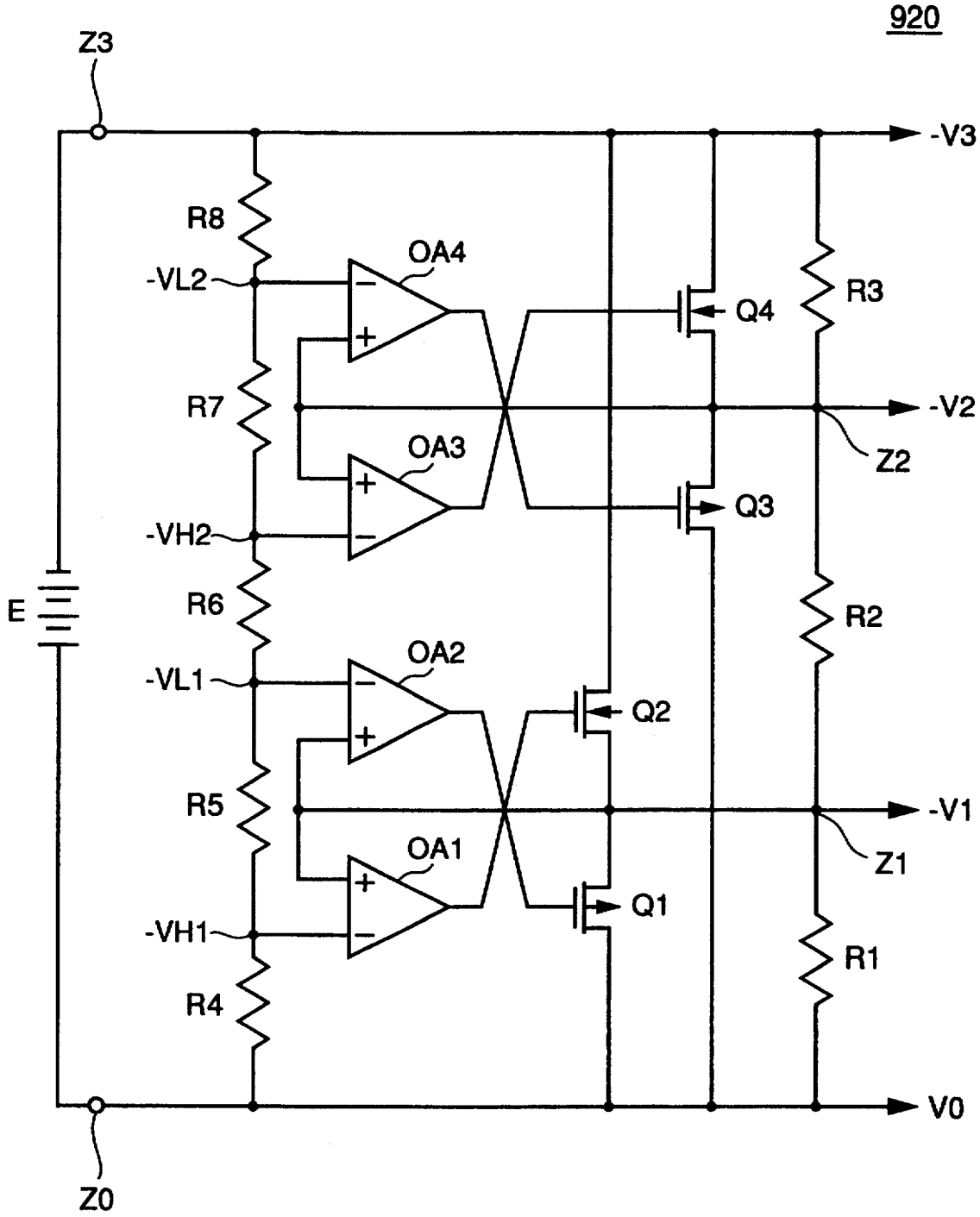
FIG. 15 PRIOR ART
FIG. 15 shows an arrangement of a power supply circuit 920 disclosed in Document 1.
Figure 16:
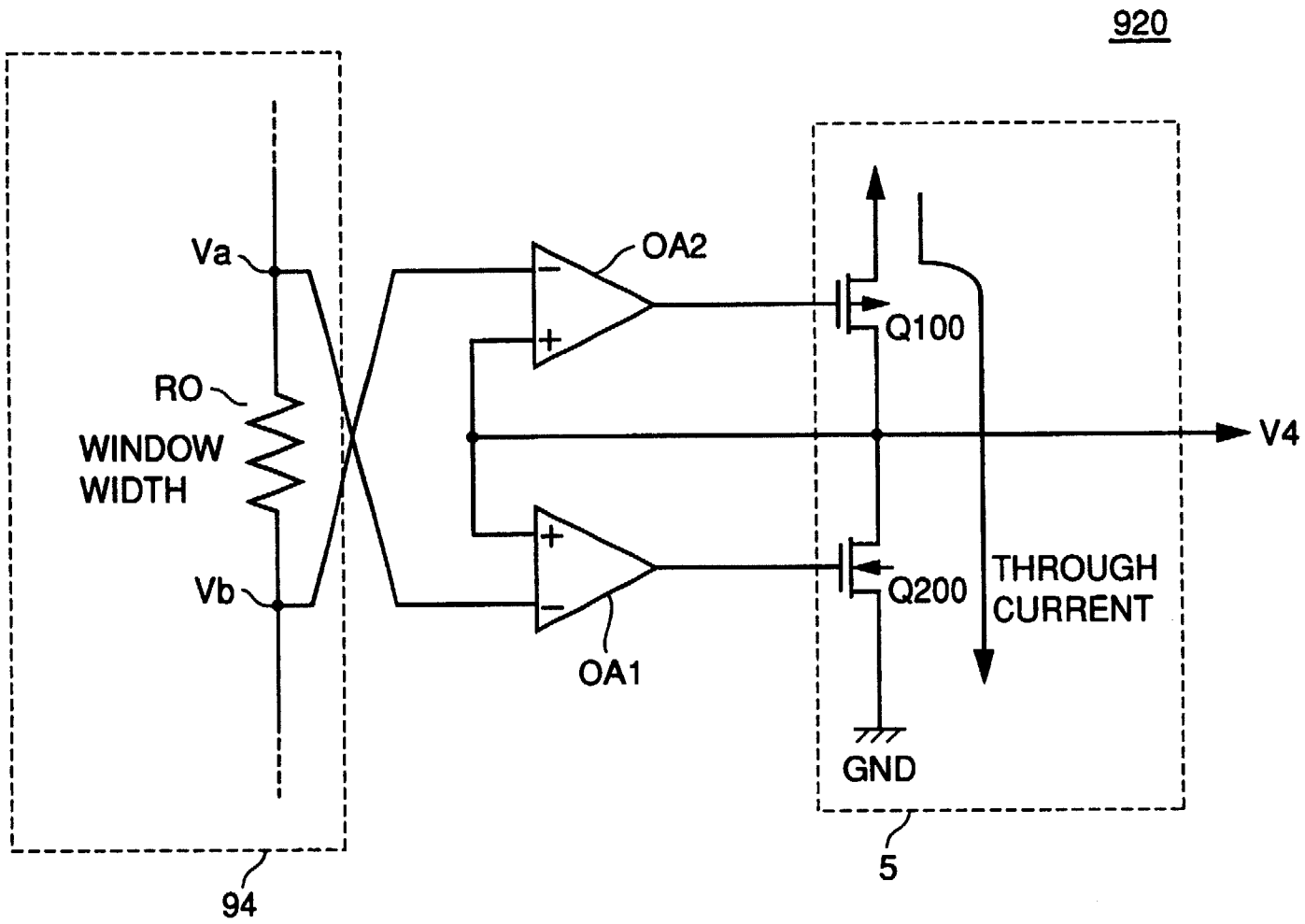
FIG. 16 PRIOR ART
FIG. 16 shows an arrangement of part of the power supply circuit corresponding to FIG. 15.

For output Vn (n =0, 1, 2, 3 . . . ) of the power supply circuits in the first, second and third embodiments described above, bleeder resistors (R1 to R3 in FIG. 15) may be provided as in the output stages of power supply circuit 920. Furthermore, a capacitor may be provided between the node for outputting voltage Vn and the node for receiving the ground voltage to smooth the voltage.

Although application examples as a power supply circuit of a liquid crystal display device are described, the present invention is not always limited to the examples but it can be applied to a power supply circuit for another display device and power supply circuits in general.

Especially since unnecessary current consumption can be reduced, the arrangement is extremely effective to a power supply circuit for display driving purposes used in a portable unit.

For example, the display functions of mobile phones have been expanded year by year and liquid crystal display panels used therefor have been made larger. Correspondingly, the circuits such as the control circuits and the drive circuits, e.g. driver circuits have increased. The increased internal circuits result in increase in power consumption and apply huge burdens on the batteries of the mobile phones which are driven by the batteries. It is therefore essential to reduce useless power consumption as much as possible.

Figure 9:
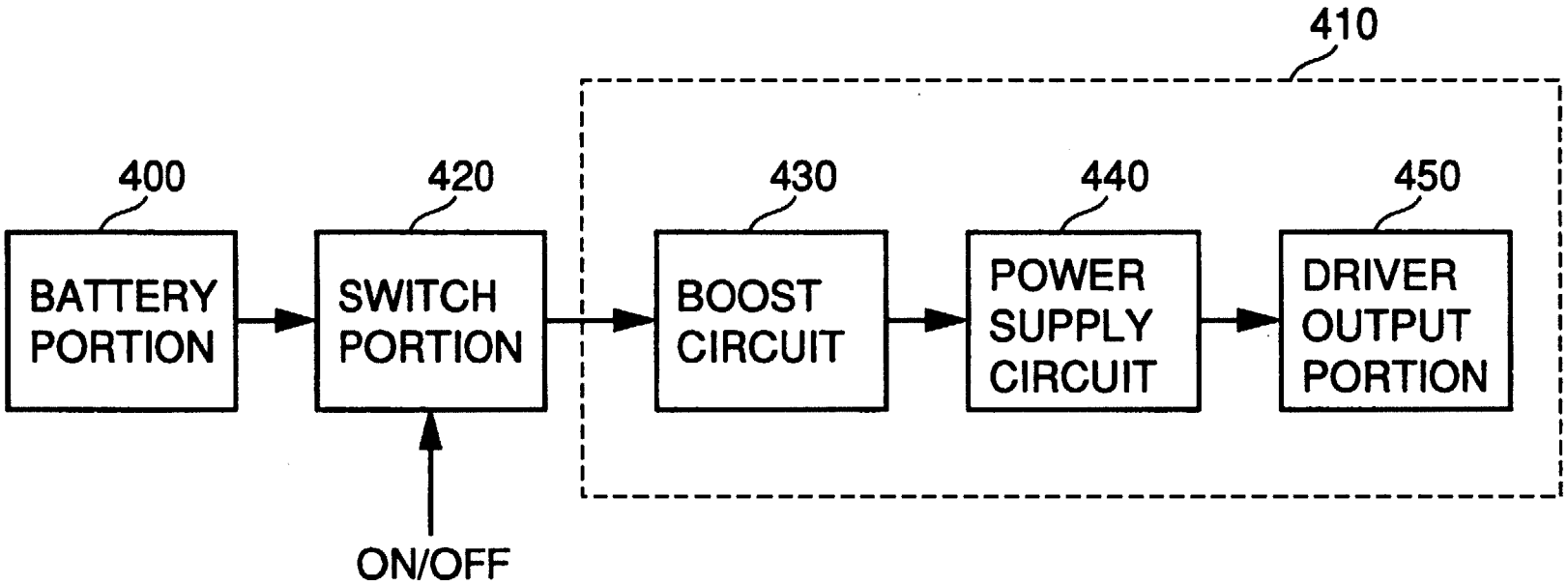
FIG. 9 is a block diagram for illustrating a power supply circuit in a mobile phone.

Inherently, the power supply of a mobile phone is frequently turned off/on. As shown in FIG. 9, the mobile phone includes a battery portion 400, a circuit portion 410, and a switch portion 420 which connects circuit portion 410 and battery portion 400. When power is off, switch portion 420 between battery portion 400 and circuit portion 410 is turned off to prevent a current flow to circuit portion 410.

When the power supply is switched from its off state to its on state, battery portion 400 and circuit portion 410 are connected to each other, and a boost circuit 430 included in circuit portion 410 first boosts the battery voltage. The boosted voltage output from boost circuit 430 serves as power supply voltage VEE for the reference voltage generation circuit described above. Based on the boosted voltage, power supply circuit 440 generates a desired drive voltage (intermediate voltage). A driver output portion 450 included in circuit portion 410 which receives an output of power supply circuit 440 outputs voltages which correspond to sounds, characters and image information.

Figure 10A:
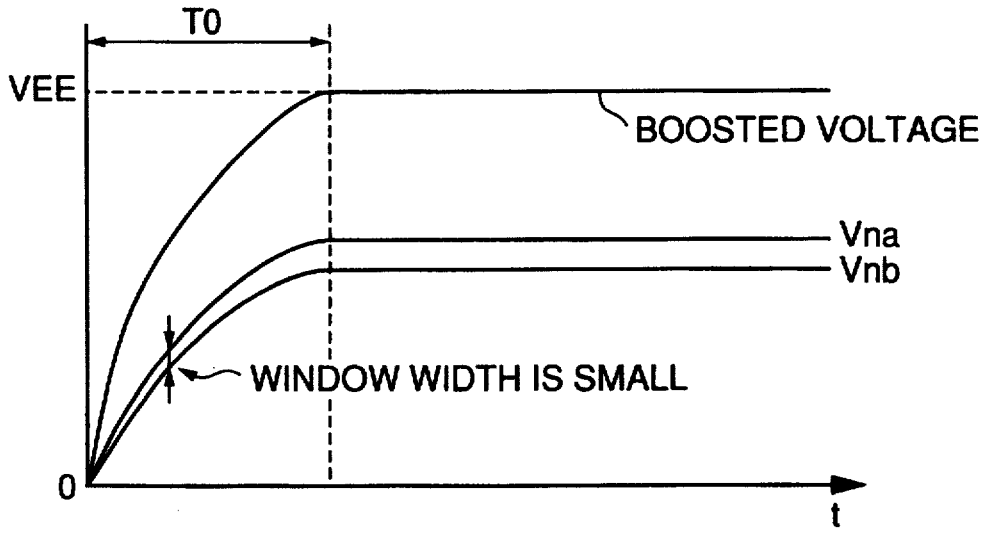
FIGS. 10A and 10B are voltage/signal waveform charts for illustrating the effects of the present invention.

However, as shown in FIG. 10A, the output of the boost circuit is lower than VEE as an expected value level at the beginning of a transition period T0 when the power supply rises from its off state to its on state (from 0 volt to VEE). Thus, the window width (Vna–Vnb) is naturally small at that time. If a conventional power supply circuit which does not include through current prevention circuits 3, 33 is used, therefore, the PMOS transistor and the NMOS transistor which form the output buffer are momentarily on at the same time. In other words, a through current is provided. Since a mobile phone is frequently switched on/off, the influence of the through current during the transition period on battery consumption cannot be ignored.

For this problem, power supply circuit 440 is formed of power supply circuits 100 to 300 to prevent occurrence of the through current and reduce power consumption. Thus, a mobile phone which can be driven for a longer time period even if it is driven by a battery can be provided.

Figure 10B:
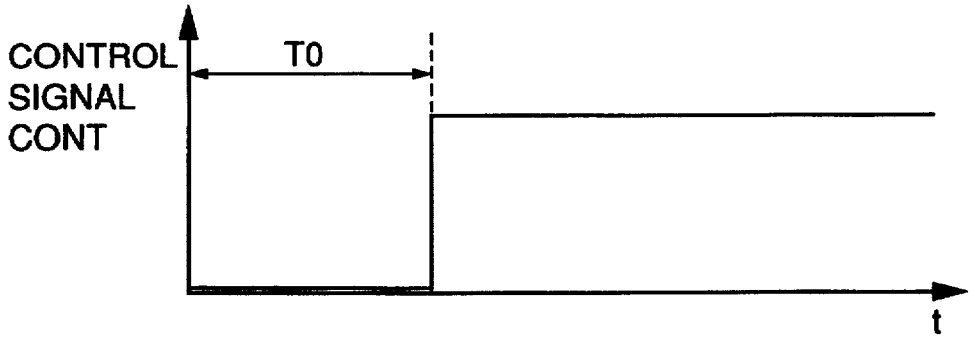
Figure 11:
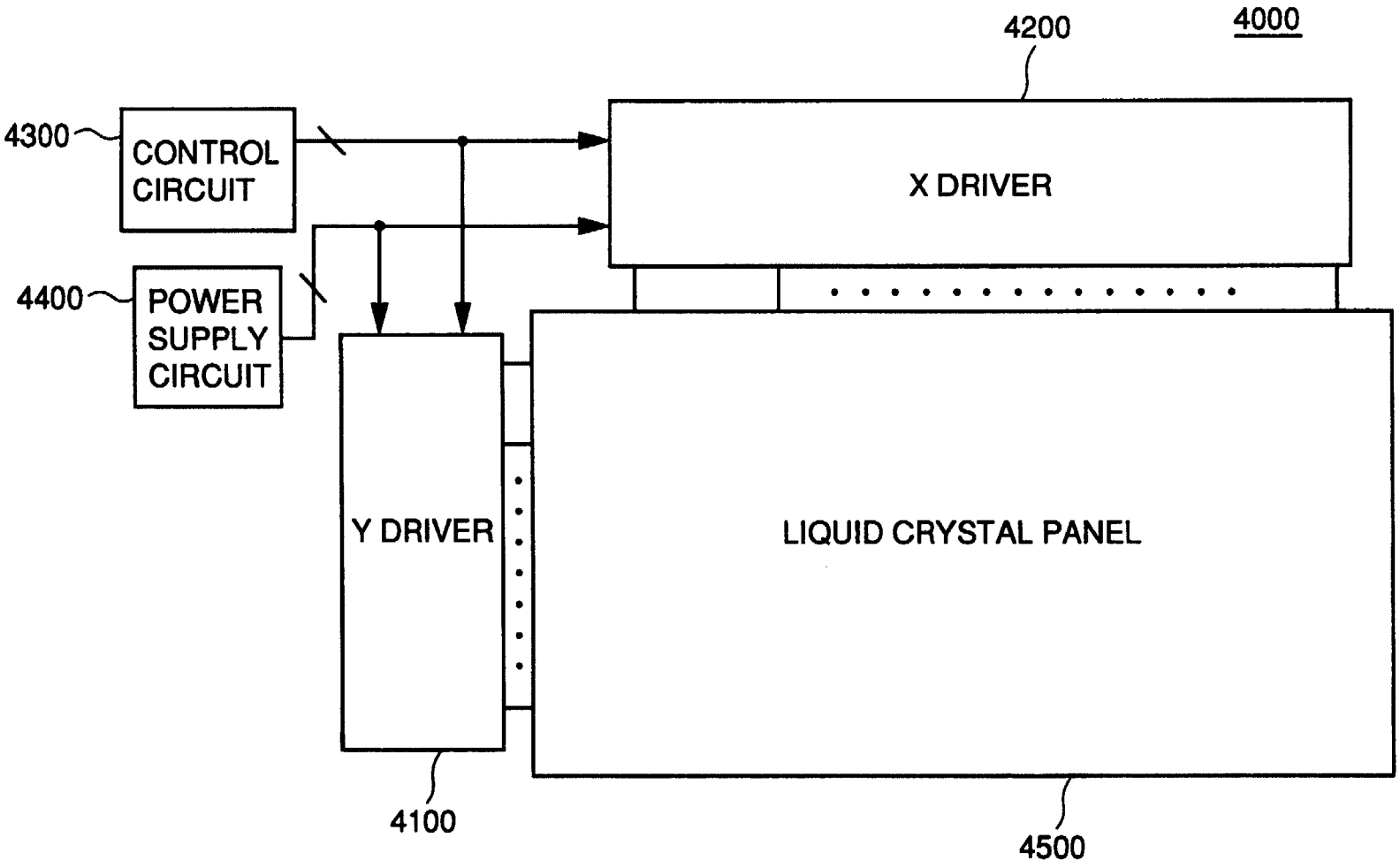
FIG. 11 PRIOR ART
FIG. 11 is a block diagram showing a schematic arrangement of a conventional liquid crystal display device 4000.
Figure 12:
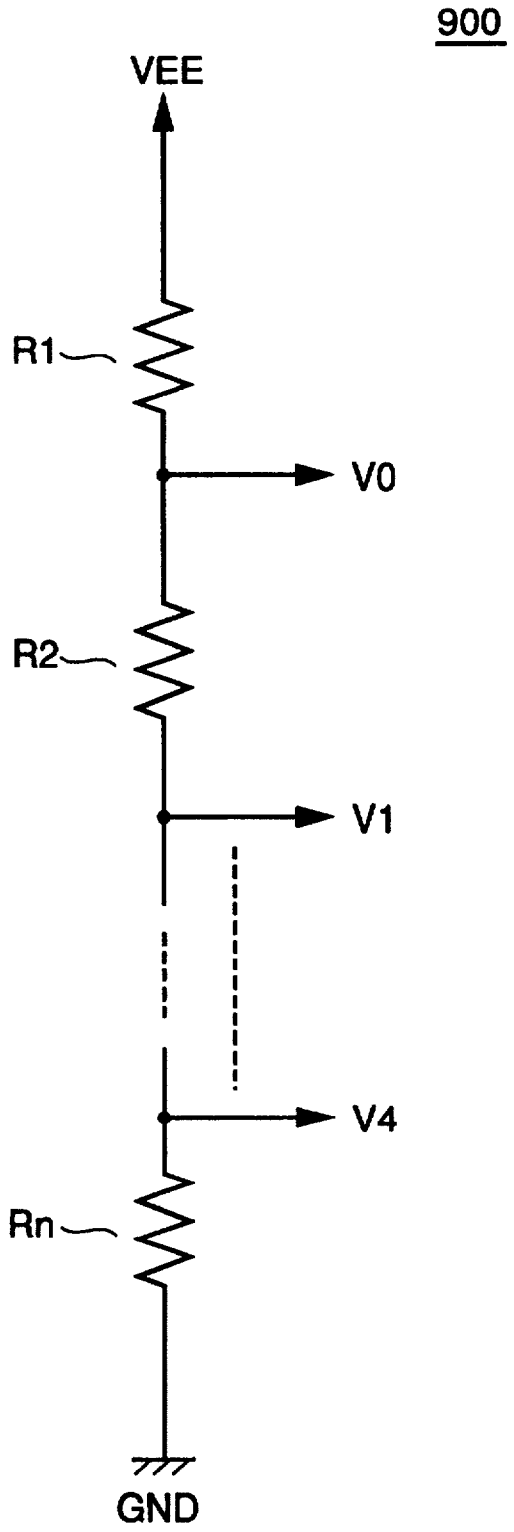
FIG. 12 PRIOR ART
FIG. 12 is a circuit diagram showing one example of an arrangement of a conventional power supply circuit 900.
Figure 13:
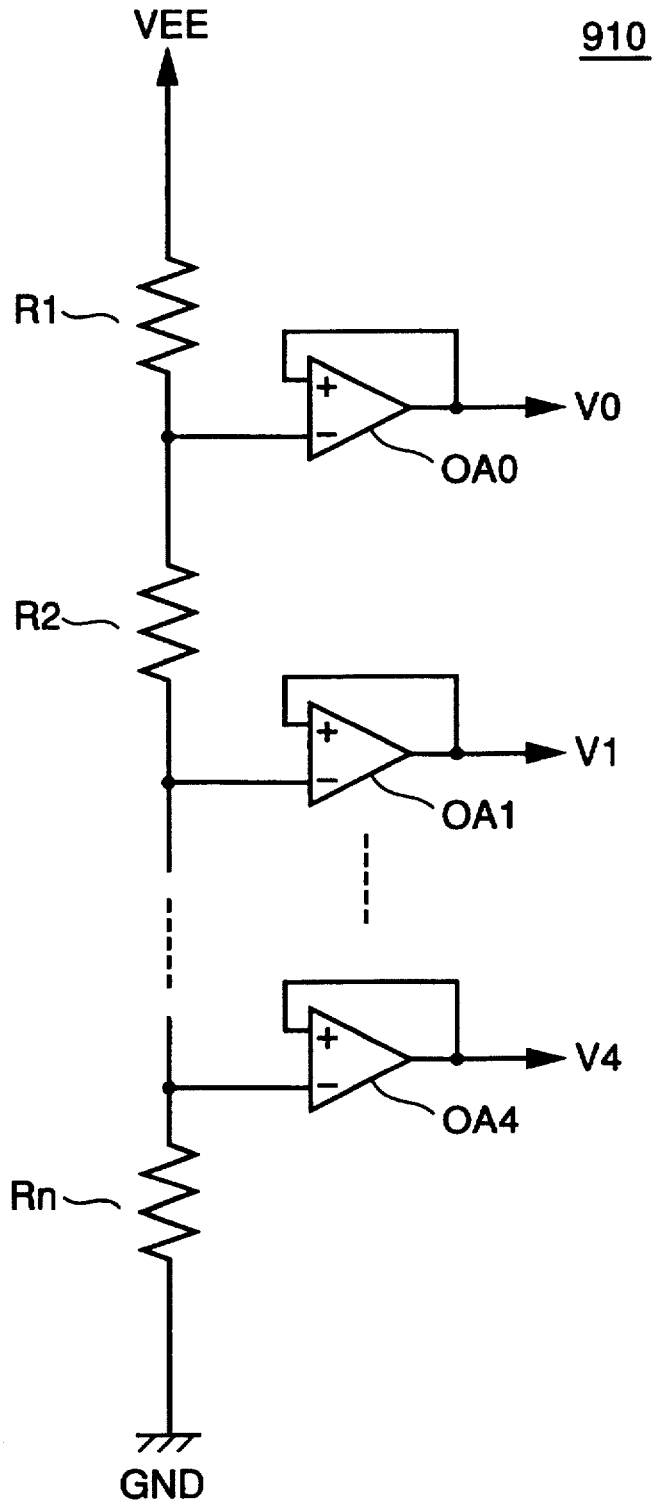
FIG. 13 PRIOR ART
FIG. 13 is a circuit diagram showing one example of an arrangement of a conventional power supply circuit 910.
Figure 14:
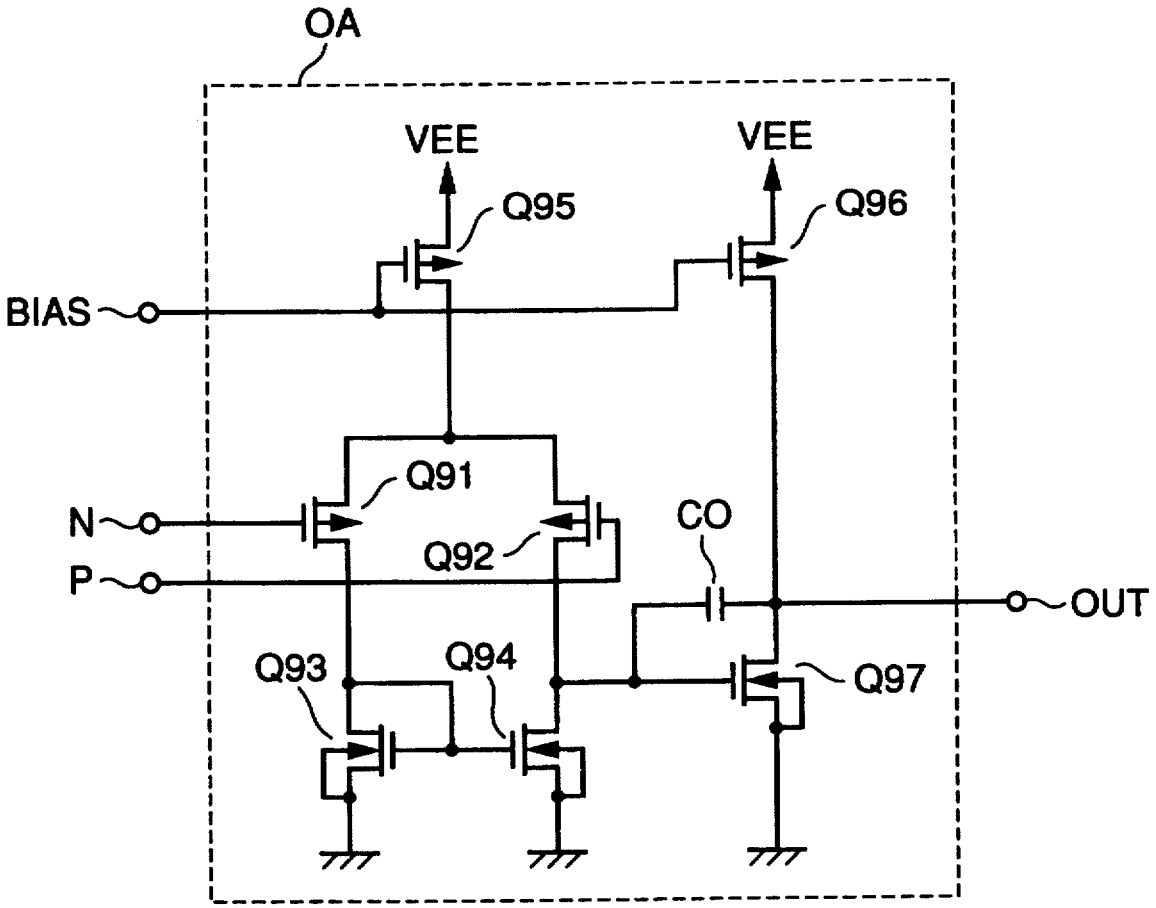
FIG. 14 PRIOR ART
FIG. 14 is a circuit diagram showing an operational amplifier arrangement.

In addition, power supply circuit 200 is used to drive control signal CONT to the L level during transition period T0 while the power supply rises from its off state to its on state as shown in FIG. 10B, for example, thereby interrupting a current flow in the power supply circuit, and to drive control signal CONT to the H level after the voltage to be supplied to the power supply circuit is stabilized. Thus, useless current consumption at the initial power supply rising period can be eliminated.

By preventing the large through current, although momentarily, using the power supply circuit according to the present invention, the boosted voltage can be raised quickly and a desired stable boosted voltage can be obtained at high speed. Therefore, the circuit can start operating rapidly after the power supply turns on.

Increase in the number of circuits due to the present invention is little and increase in the LSI chip sizes and the cost therefor are not observed. Therefore, the power supply circuit can be incorporated in a driver circuit IC, a control circuit IC or the like in a liquid crystal display device so that the power supply circuit is provided together with it on one chip.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A power supply circuit to generate an intermediate voltage between a power supply voltage applied to a power supply node and a ground voltage applied to a ground node, comprising:

a reference voltage generation circuit to generate a reference voltage which defines an acceptable fluctuation range of said intermediate voltage;

a voltage comparison circuit to compare said intermediate voltage and said reference voltage and output the comparison result;

a pair of switches connected between said power supply node and a voltage output node from which said intermediate voltage is output and between said ground node and said voltage output node and controlled to turn on/off according to an output of said voltage comparison circuit; and a through current prevention circuit to prevent a through current caused between said power supply node and said ground node through said pair of switches.

2. The power supply circuit according to claim 1, wherein said voltage comparison circuit includes a differential amplification circuit to receive said reference voltage and said intermediate voltage at its inputs, and an output circuit to output a signal corresponding to said comparison result according to an output of said differential amplification circuit, said pair of switches includes first and second transistors receiving an output of said output circuit at their gates, and said through current prevention circuit turns off one of said first and second transistors, if another of said first and second transistors turns on, according to the output of said differential amplification circuit.

3. The power supply circuit according to claim 2, wherein said reference voltage generation circuit generates an upper limit reference voltage which defines an upper limit of said acceptable fluctuation range and a lower limit reference voltage which defines a lower limit of said acceptable fluctuation range, said differential amplification circuit includes a first differential amplification circuit to receive said upper limit reference voltage and said intermediate voltage at its inputs, and a second differential amplification circuit to receive said lower limit reference voltage and said intermediate voltage at its inputs, said output circuit includes a first output circuit to output a signal corresponding to a result of comparison between said upper limit reference voltage and said intermediate voltage according to an output of said first differential amplification circuit, and a second output circuit to output a signal corresponding to a result of comparison between said lower limit reference voltage and said intermediate voltage according to an output of said second differential amplification circuit, and one of said first and second transistors is connected to an output of said first output circuit and another of said first and second transistors is connected to an output of said second output circuit.

4. The power supply circuit according to claim 1, further comprising:

a control switch to electrically connect/disconnect a current path to said pair of switches according to a control signal.

5. The power supply circuit according to claim 2, wherein said differential amplification circuit includes a third transistor receiving said reference voltage at its gate, a fourth transistor receiving said intermediate voltage at its gate, a current source to supply a current to said third and fourth transistors, and a control switch to electrically connect/disconnect a current path between said third and fourth transistors and said current source according to a control signal.

6. The power supply circuit according to claim 2, wherein said output circuit includes an output node to output a signal corresponding to said comparison result, a third transistor connected between said output node and a prescribed voltage and receiving the output of said differential amplification circuit at its gate, a current source to supply a current to said output node, and a control switch to electrically connect/disconnect a current path between said current source and said third transistor according to a control signal.

7. A liquid crystal display device, comprising:

a liquid crystal panel including a plurality of pixels;

a drive circuit to drive said liquid crystal panel; and a power supply circuit to generate an intermediate voltage between a power supply voltage applied to a power supply node and a ground voltage applied to a ground node and supply the intermediate voltage to said drive circuit, said power supply circuit including a reference voltage generation circuit to generate a reference voltage which defines an acceptable fluctuation range of said intermediate voltage, a voltage comparison circuit to compare said intermediate voltage and said reference voltage and output the comparison result, a pair of switches connected between said power supply node and a voltage output node from which said intermediate voltage is output and between said ground node and said voltage output node and controlled to turn on/off according to the output of said voltage comparison circuit, and a through current prevention circuit to prevent a through current caused between said power supply node and said ground node through said pair of switches.

8. The liquid crystal display device according to claim 7, wherein said voltage comparison circuit includes a differential amplification circuit to receive said reference voltage and said intermediate voltage at its inputs, and an output circuit to output a signal corresponding to said comparison result according to an output of said differential amplification circuit, said pair of switches includes first and second transistors receiving an output of said output circuit at their gates, and said through current prevention circuit turns off one of said first and second transistors, when another of said first and second transistors turns on, according to the output of said differential amplification circuit.

9. The liquid crystal display device according to claim 8, wherein said reference voltage generation circuit generates an upper limit reference voltage which defines an upper limit of said acceptable fluctuation range and a lower limit reference voltage which defines a lower limit of said acceptable fluctuation range, said differential amplification circuit includes a first differential amplification circuit to receive said upper limit reference voltage and said intermediate voltage at its inputs, and a second differential amplification circuit to receive said lower limit reference voltage and said intermediate voltage at its inputs, said output circuit includes a first output circuit to output a signal corresponding to a result of comparison between said upper limit reference voltage and said intermediate voltage according to an output of said first differential amplification circuit, and a second output circuit to output a signal corresponding to a result of comparison between said lower limit reference voltage and said intermediate voltage according to an output of said second differential amplification circuit, and one of said first and second transistors is connected to an output of said first output circuit and another of the first and second transistors is connected to an output of second output circuit.

10. The liquid crystal display device according to claim 7, further comprising:

a control switch to electrically connect/disconnect a current path to said pair of switches according to a control signal.

11. The liquid crystal display device according to claim 8, wherein said differential amplification circuit includes a third transistor receiving said reference voltage at its gate, a fourth transistor receiving said intermediate voltage at its gate, a current source to supply a current to said third and fourth transistors, and a control switch to electrically connect/disconnect a current path between said third and fourth transistors and said current source according to a control signal.

12. The liquid crystal display device according to claim 8, wherein said output circuit includes an output node to output a signal corresponding to said comparison result, a third transistor connected between said output node and a prescribed voltage and receiving the output of said differential amplification circuit at its gate, a current source to supply a current to said output node, and a control switch to electrically connect/disconnect a current path between said current source and said third transistor according to a control signal.

* * * * *